US007814567B2

(12) United States Patent
Dovner et al.

(10) Patent No.: US 7,814,567 B2
(45) Date of Patent: Oct. 19, 2010

(54) PROTECTIVE GARMENT HAVING A QUICK RELEASE SYSTEM

(75) Inventors: Edward R. Dovner, Brockton, MA (US); Gary Lesley, Burnsville, MN (US)

(73) Assignee: First Choice Armor & Equipment, Inc., Brockton, MA (US)

( * ) Notice: Subject to any disclaimer, the term of this patent is extended or adjusted under 35 U.S.C. 154(b) by 0 days.

(21) Appl. No.: 11/507,635

(22) Filed: Aug. 21, 2006

(65) Prior Publication Data

US 2010/0235957 A1 Sep. 23, 2010

Related U.S. Application Data

(60) Provisional application No. 60/812,656, filed on Jun. 9, 2006.

(51) Int. Cl.
*F41H 1/02* (2006.01)

(52) U.S. Cl. ..... 2/2.5

(58) Field of Classification Search ..... 2/2.5, 2/102, 108, 94, 96, 97, 462, 464, 467
See application file for complete search history.

(56) References Cited

U.S. PATENT DOCUMENTS 4,697,285 A 10/1987 Sylvester
5,012,964 A 5/1991 Falletta et al.
5,881,487 A 3/1999 Chalker
6,421,833 B2 * 7/2002 Khanamirian et al. ..... 2/69
6,487,761 B2 12/2002 Tassel
6,766,532 B1 * 7/2004 Cabana ..... 2/44
6,769,137 B2 8/2004 D'Annunzio
6,823,529 B1 * 11/2004 Dako ..... 2/2.5
6,845,523 B2 * 1/2005 Copp ..... 2/463
6,948,188 B2 9/2005 D'Annunzio
7,047,570 B2 5/2006 Johnson
2002/0120973 A1 9/2002 D'Annunzio
2004/0221361 A1 11/2004 D'Annunzio

* cited by examiner

*Primary Examiner*—Tejash Patel
(74) *Attorney, Agent, or Firm*—Greenberg Traurig, LLP

(57) ABSTRACT

A protective garment, such as a body armor vest, equipped with a quick-release system comprising a front portion, a rear portion, and a plurality of connectors for releasably attaching the front portion to the rear portion. Each connector includes a ring and a releasable hook, wherein the ring can be releasably clasped by the releasable hook. The protective garment further includes a pull cord, which can be attached to and capable of disengaging, at least two of the plurality of connectors to allow detachment of the front portion from the rear portion.

13 Claims, 9 Drawing Sheets

PROTECTIVE GARMENT HAVING A QUICK RELEASE SYSTEM

CROSS-REFERENCE TO RELATED APPLICATIONS

This application claims priority to and the benefit of U.S. Provisional Application No. 60/812,656, filed Jun. 9, 2006, entitled "SYSTEMS FOR USE WITH PROTECTIVE GARMENTS", the entirety of which is incorporated herein by reference.

FIELD OF THE INVENTION

The present invention relates to outer garments, and more particularly to protective outer garments having quick release systems.

BACKGROUND

Oftentimes, such as in emergency situations, protective outer garments including tactical vests, body armor vests, safety vests, and other protective outer garments need to be removed quickly. For example, when a soldier or law enforcement officer is wearing a protective vest and is injured or incapacitated, in order to provide immediate medical attention, the protective vest needs to be removed as quickly as possible. Similarly, a soldier, in danger of drowning due to being weighed down by protective outer garments along with the equipment and ammunition thereon, can save himself by quickly removing his protective outer garments. A protective garment may also need to be removed quickly, simply so the wearer can quickly change gear and put on other protective outer garments.

Protective outer garments such as military vests, tactical ballistic vests and body armor vests are usually detachable at the shoulders, and at the sides of the vest. The attachment mechanism typically includes Velcro fasteners, snap fasteners, buckles or other fastening hardware. To put on or remove the protective outer garment, a wearer must manipulate several fasteners typically one at a time. This can be a time consuming process, or may not be possible.

Currently, some protective outer garments are equipped with systems that allow a user to quickly detach, and remove these protective outer garments. Specifically, "cutaway" vests are described in U.S. Pat. No. 6,948,188, U.S. Pat. No. 6,769,137, U.S. Patent Application Publication No. 2004/0221361, and U.S. Patent Application Publication No. 2002/0120973. The systems used in connection with these vests are generally based on parachute technology, where the emphasis is on complete deployment and not on reassembly of the protective vest subsequent to removal. Similarly, these systems emphasize an all or nothing approach, which results in total removal and separation of the protective garment. There is no intermediate options provided, such as, a capability for only partial removal of the protective garment.

Cutaway vests typically have three main components, a front portion, a rear portion, and a cummerbund. Generally, the front and rear portions of the vest, and cummerbund can be releasably attached together by cables. The cables can be routed through a series of rings and loops that are attached to the fabric of the vest, thereby releasably interlocking the vest components together. In operation, a wearer pulls a handle that is attached to the cables and withdraws the cables from the vest, thereby releasing the vest components, which can then be disengaged from the wearer. To reassemble the cutaway vest, the cables need to be rerouted through the entire series of rings and loops throughout the vest, thereby interlocking the vest components together. This can be a time consuming and tedious process.

Accordingly, a protective outer garment having a quick release system is needed that provides a reduction in operating parts, faster release, and quicker reassembly than the systems currently in use.

SUMMARY OF THE INVENTION

The present invention provides, in an embodiment, a protective garment having a front portion, a rear portion, and a quick release system having a plurality of connectors for releasably attaching the front portion to the rear portion, and a pull cord. The pull cord can be attached to, and capable of disengaging at least two connectors, to allow detachment of the front portion from the rear portion.

In an embodiment, each connector includes a ring designed to be releasably clasped by a releasable hook. The ring can be affixed via a strap to the rear portion, and the releasable hook can be affixed to the front portion of the garment. The pull cord can be attached to a release knob located on the releasable hook, so that pulling on the pull cord can cause the release knob to move and open the releasable hook. In the open position the releasable hook can release the ring and disengage the connector, and permit the front and rear portions to simply fall away from a wearer.

In another embodiment, the present invention provides a protective garment having a front portion, a rear portion, a plurality of rings and a plurality of releasable hooks for releasably attaching the front portion to the rear portion, and a pull cord. The pull cord can be attached to, and capable of disengaging at least two releasable hooks of the plurality of releasable hooks, to allow detachment of the front portion from the rear portion.

In another embodiment, the present invention provides a method for quickly removing a garment. The method includes wearing a protective garment that has a front portion, a rear portion, a plurality of connectors for releasably attaching the front portion to the rear portion, and a pull cord that can be attached to, and capable of disengaging at least two of the plurality of connectors to allow detachment of the front portion from the rear portion. The method further includes the step of pulling the pull cord on the protective garment to disconnect the front portion from the rear portion.

In another embodiment, the present invention provides a method for quickly removing a garment. The method includes wearing a protective garment that has a front portion, a rear portion, a plurality of rings and a plurality of releasable hooks for releasably attaching the front portion to the rear portion, and a pull cord that can be attached to, and capable of disengaging at least two releasable hooks of the plurality of releasable hooks to allow detachment of the front portion from the rear portion. The method further includes the step of pulling the pull cord on the protective garment to detach the front portion from the rear portion.

In a still further embodiment, the present invention provides a method for quickly removing a garment. The method includes wearing a protective garment having a front portion and a rear portion, both of which include respective torso portions, shoulder portions, and side portions. The method further includes the step of disconnecting the shoulder portions of the front portion from the shoulder portions of the rear portion, and the side portions of the rear portion from the side portions of the front portion.

DESCRIPTION OF SPECIFIC EMBODIMENTS

In view of the limitations now present in the prior art, the present invention provides a new protective outer garment having a quick release system that can reduce the number of operating parts, allow faster release, and permit quicker reassembly than the cable release systems currently in use.

Generally, the present invention provides a protective garment, such as a tactical ballistic vest, having a quick release system for separating the protective garment into a reduced number of components, for instance, a front portion and rear portion. In an embodiment, the front and rear portions of the vest can separate at the shoulders, and at the sides of the waist. These two portions can be held together, for instance, by four connectors, one for each shoulder and one for each side of the waist.

Figure 1A:
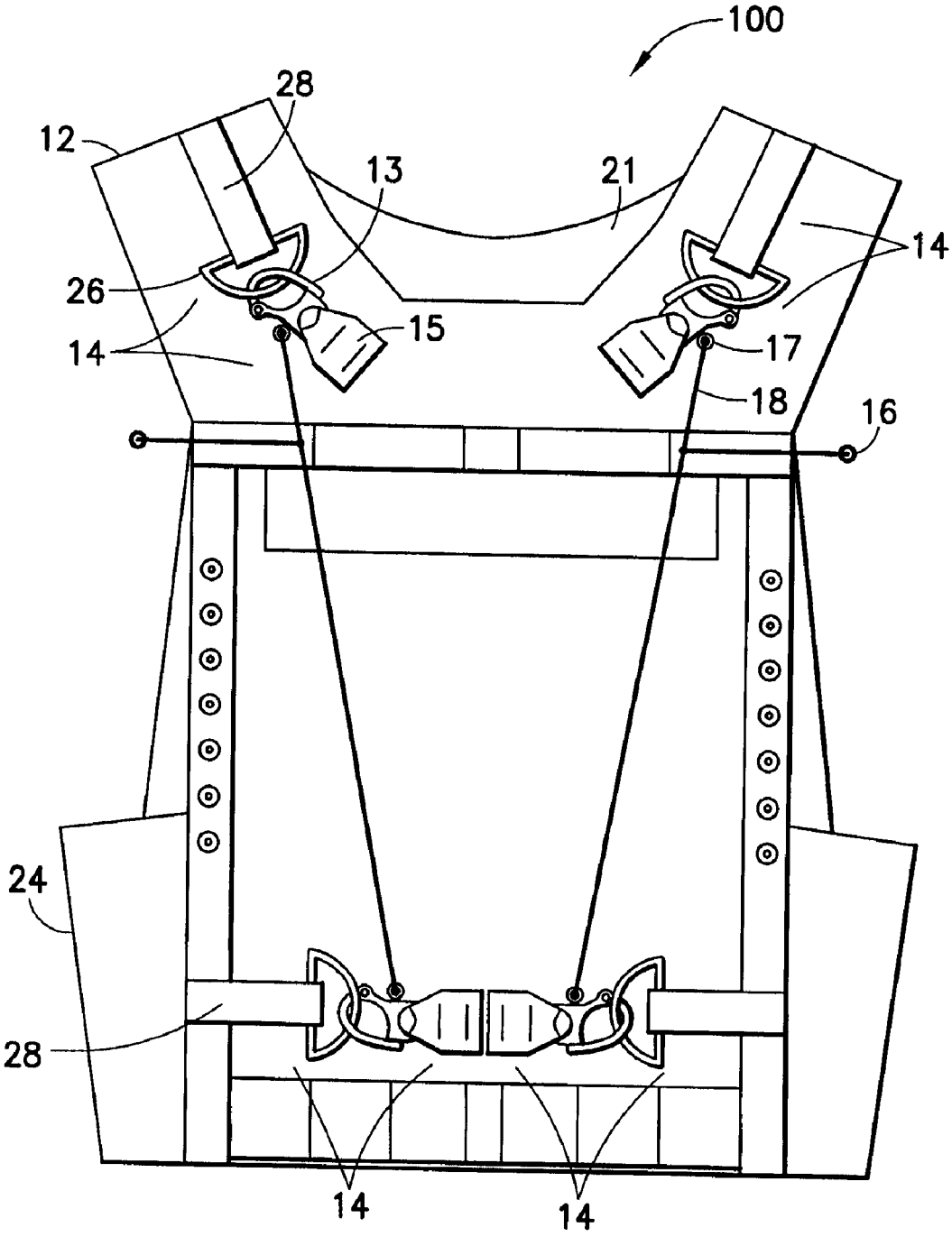
FIG. 1A illustrates a frontal view of a protective outer garment equipped with a quick release system in accordance with principles of the present invention.
Figure 1B:
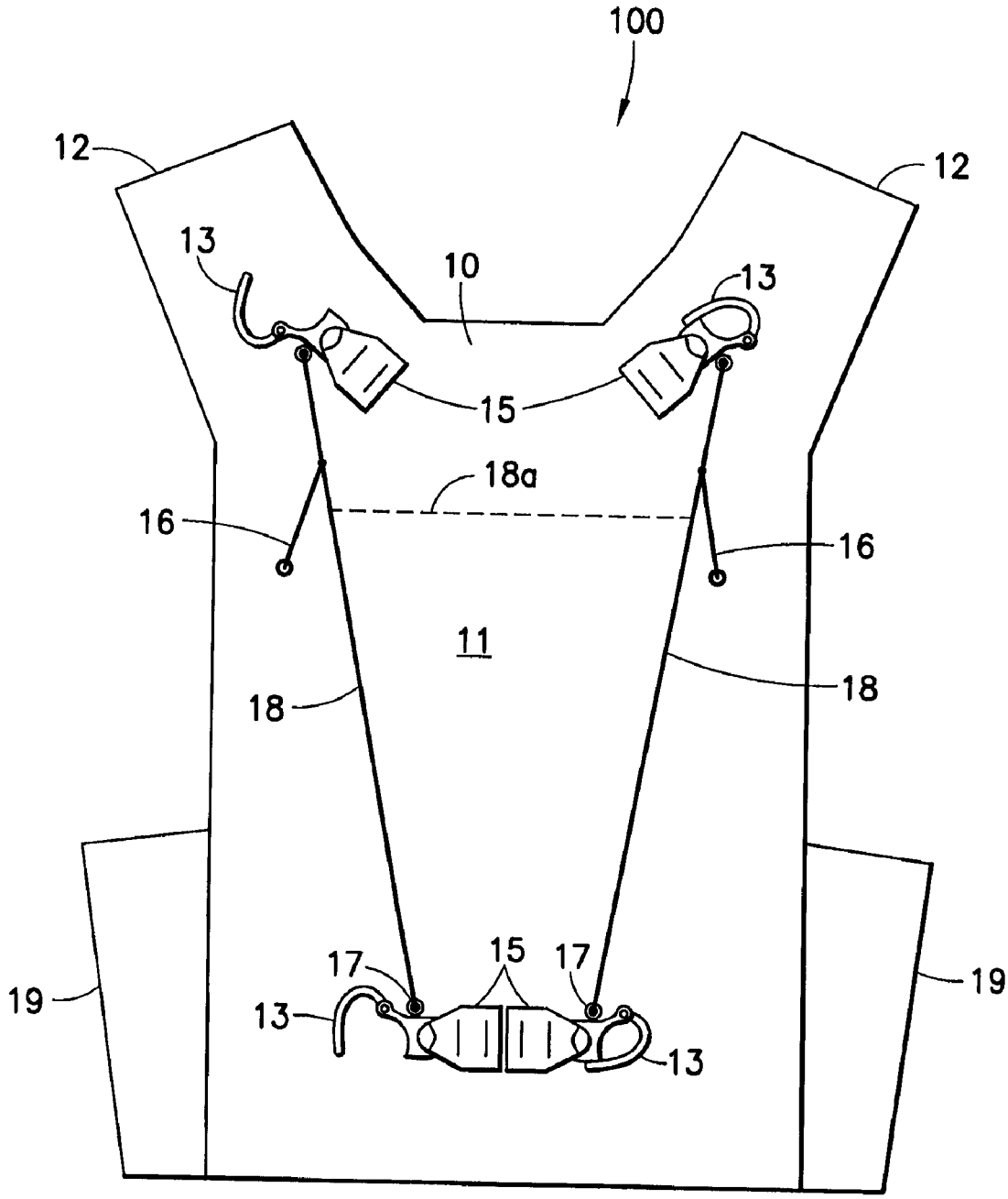
FIG. 1B illustrates a front portion of a tactical ballistic vest for use in connection with an embodiment of the present invention.
Figure 1C:
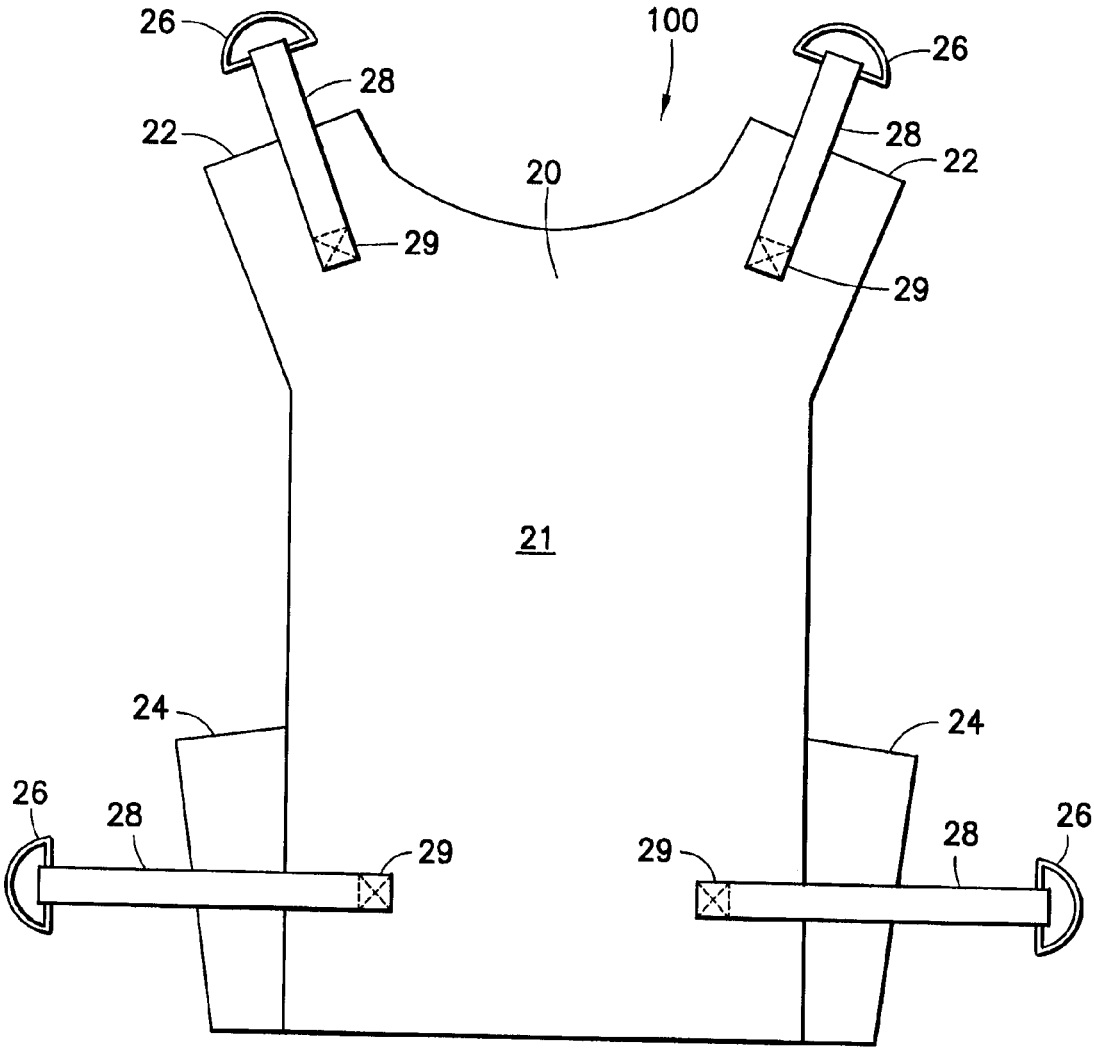
FIG. 1C illustrates a rear portion of a tactical ballistic vest for use in connection with an embodiment of the present invention.

With reference now to FIGS. 1A-1C, FIG. 1A illustrates a frontal view of a tactical ballistic vest 100 equipped with a quick release system in accordance with an embodiment of the present invention. In one embodiment, the tactical ballistic vest 100, can be a solid front, side-entry style vest with adjustable shoulders and adjustable side closures. The tactical ballistic vest 100 can contain, for example, IIIA soft armor and front, rear, and side torso rifle plate protection that can be inserted or removed at will. The size of the rifle plates can vary, but includes 6×8, 7×8, 8×10, 10×12, and other Small Arms Protective Insert (SAPI) sizes. The tactical ballistic vest can also accept Department of Defense (DoD) Outer Tactical Vest (OTV) ballistic panels and enhanced protection components.

The tactical ballistic vest 100 can also accept, in an embodiment, standard military OTV additional ballistic options including groin guard, neck and throat armor, shoulder and bicep protection. Full shoulder and chest friction material can also be provided for improved weapon welds and firing positions. The tactical ballistic vest 100 can provide substantial load-bearing for Modular Lightweight Load-carrying Equipment (MOLLE), Pocket Attachment Ladder System (PALS), and Advanced Tactical (AT) style pouches and gear options. Additional features that can be provided, in an embodiment, include communication wire-routing channels, camelback hydration compatibility, and rear drag strap. The tactical ballistic vest 100 can also be integrated with military pack assemblies, and can be treated to be flame-resistant.

In an embodiment, the tactical ballistic vest 100 can have a front portion 10, a rear portion 20, a plurality of connectors 14 for releasably attaching the front portion 10 to the rear portion 20, and at least one pull cord 16 associated with connectors 14. The pull cord 16 can be attached to, and capable of disengaging at least two connectors substantially simultaneously. In particular, pulling on the pull cord 16 can disengage at least two of the connectors 14, and can allow detachment of the front portion 10 from the rear portion 20.

As illustrated in FIGS. 1B-1C, the front portion 10, and rear portion 20 can both include, in an embodiment, torso portions 11, 21 shoulder portions 12, 22, and side portions 19, 24. Both, the front portion 10 and rear portion 20 can be made of natural or synthetic material, e.g., leather, nylon, kevlar, etc. Both portions 10, 20 can also include internal pockets for holding the rifle plates discussed above. The pockets can be located in the torso portions 11, 21 and the side portions 19, 24. These pockets can be accessed from external openings, or from inside the tactical ballistic vest 100.

In accordance with one embodiment of the present invention, each of connectors 14 can include a releasable hook 13, and an anchor strap 15 located on front portion 10. Each releasable hook 13 can be fastened to one end of a corresponding anchor strap 15, with the other end of the anchor strap 15 being affixed to the front portion 10, for instance by stitching, gluing, or fastening. It should be appreciated that other types of clasps, clamps, fasteners, and snap shackles may be substituted for the releasable hooks 13.

Correspondingly, each of connectors 14 can also include a ring 26, and a strap 28, located on rear portion 20. In an embodiment, each ring 26 can be affixed to an end of the strap 28, and each strap 28 can be affixed to the rear portion 20 at its opposite end 29, for instance, by stitching, gluing, or fastening. Alternatively, in another embodiment, the releasable hooks 13 can be affixed on the rear portion 20, and the rings 26 can be affixed to the front portion 10. In an embodiment, the strap 28 and anchor strap 15 can be made of natural or synthetic material.

The releasable hook 13 and ring 26 of each connector 14 when releasably fastened together can join the front portion 10 and the rear portion 20 together, to form the tactical ballistic vest 100.

Figure 2:
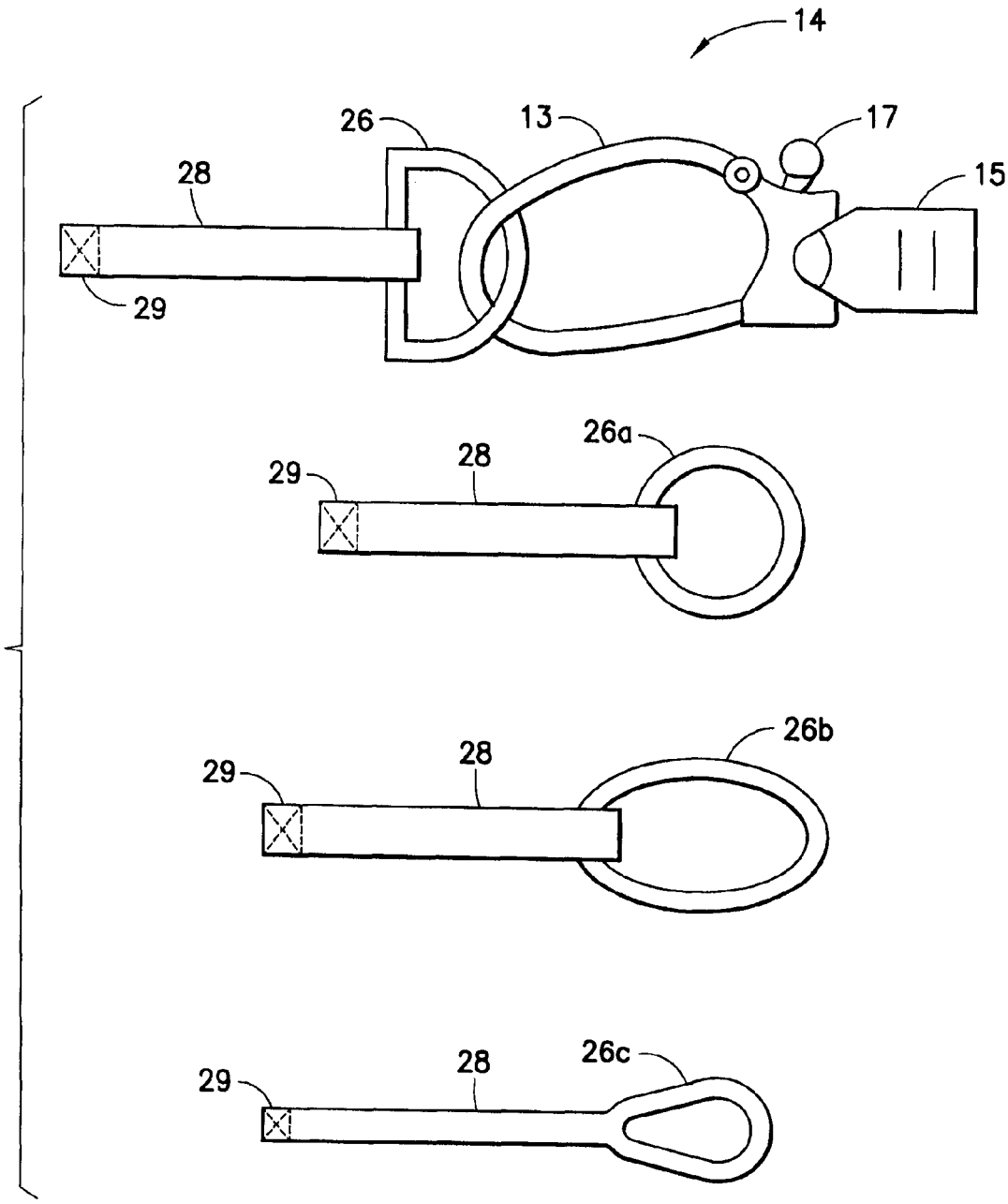
FIG. 2 illustrates components of a connector for use in connection with an embodiment of the present invention.

With reference now to FIG. 2, as noted above, each connector 14 includes a ring 26, and a releasable hook 13, wherein the ring 26 can be releasably clasped by the releasable hook 13. Each ring 26 and releasable hook 13, in an embodiment, can be made of a variety of material including metal, and plastic. Although ring 26 is depicted as a D-ring, rings having other shapes can also be used, such as, O-ring 26*a*, oval-ring 26*b*, or loops 26*c*. Similarly, although releasable hook 13, may be depicted as a snap shackle, other designs including clasps, or fasteners can readily be used and not deviate from the teachings of the present invention.

In one embodiment, the releasable hook 13 can include a release knob 17, for moving the hook into an open position. In an embodiment, the release knob 17 may be spring loaded to permit actuation of the releasable hook into an open position upon pulling of the knob 17. The release knobs 17 of two or more releasable hooks 13 can be connected together with a tether or cord 18 (See FIG. 1A). The pull cord 16 can then be attached to the cord 18, such that pulling on the pull cord 16 initiates the release knobs 17 that are interconnected by cord 18. This causes the corresponding releasable hooks 13 to open, thereby releasing the rings 26 from the releasable hooks 13 and disengaging the connectors 14. The front portion 10 and rear portion 20 can then simply fall away from a wearer.

Figure 4:
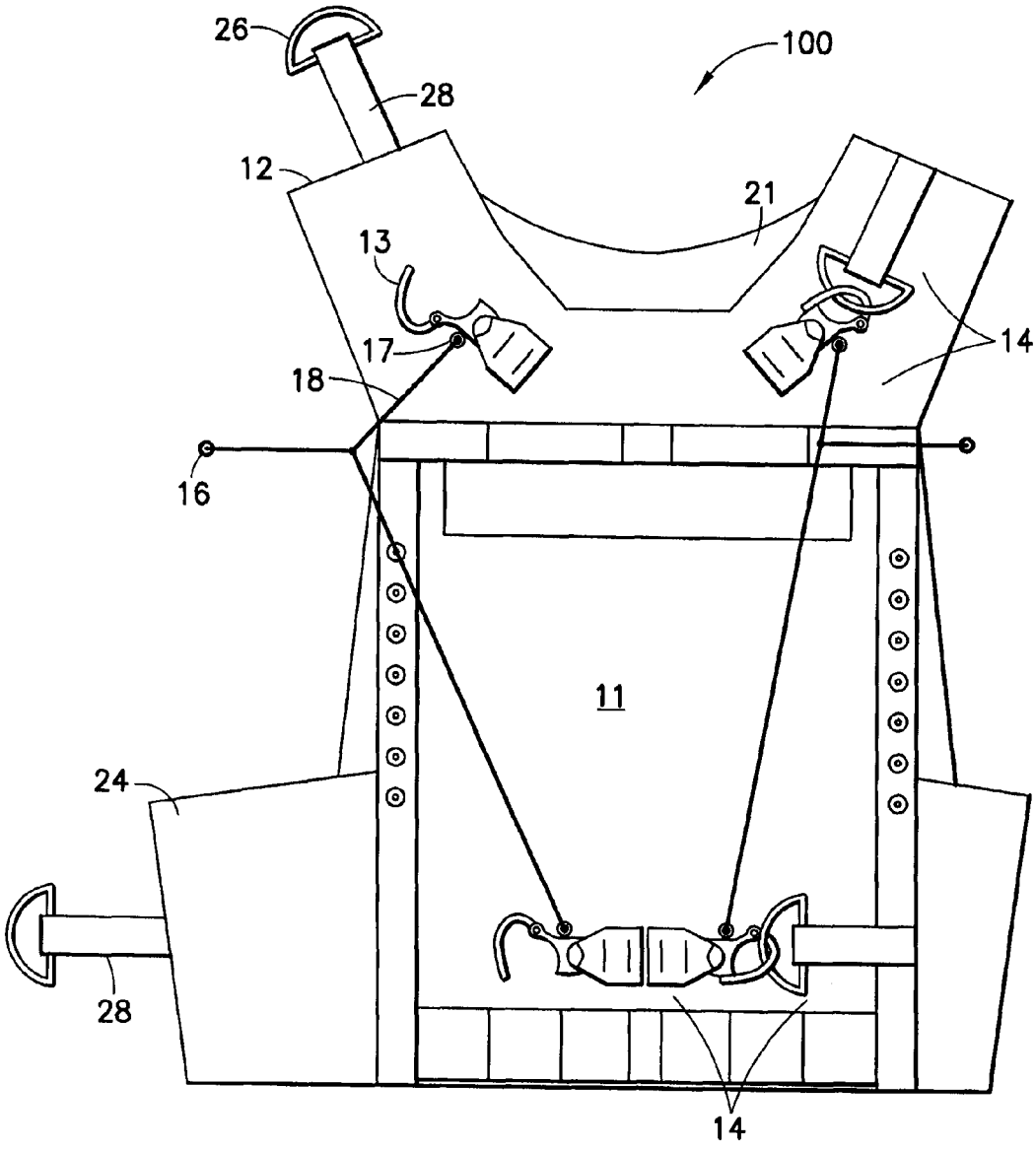
FIG. 4 illustrates partial disengagement of the quick release system in accordance with an embodiment of the present invention.
Figure 5:
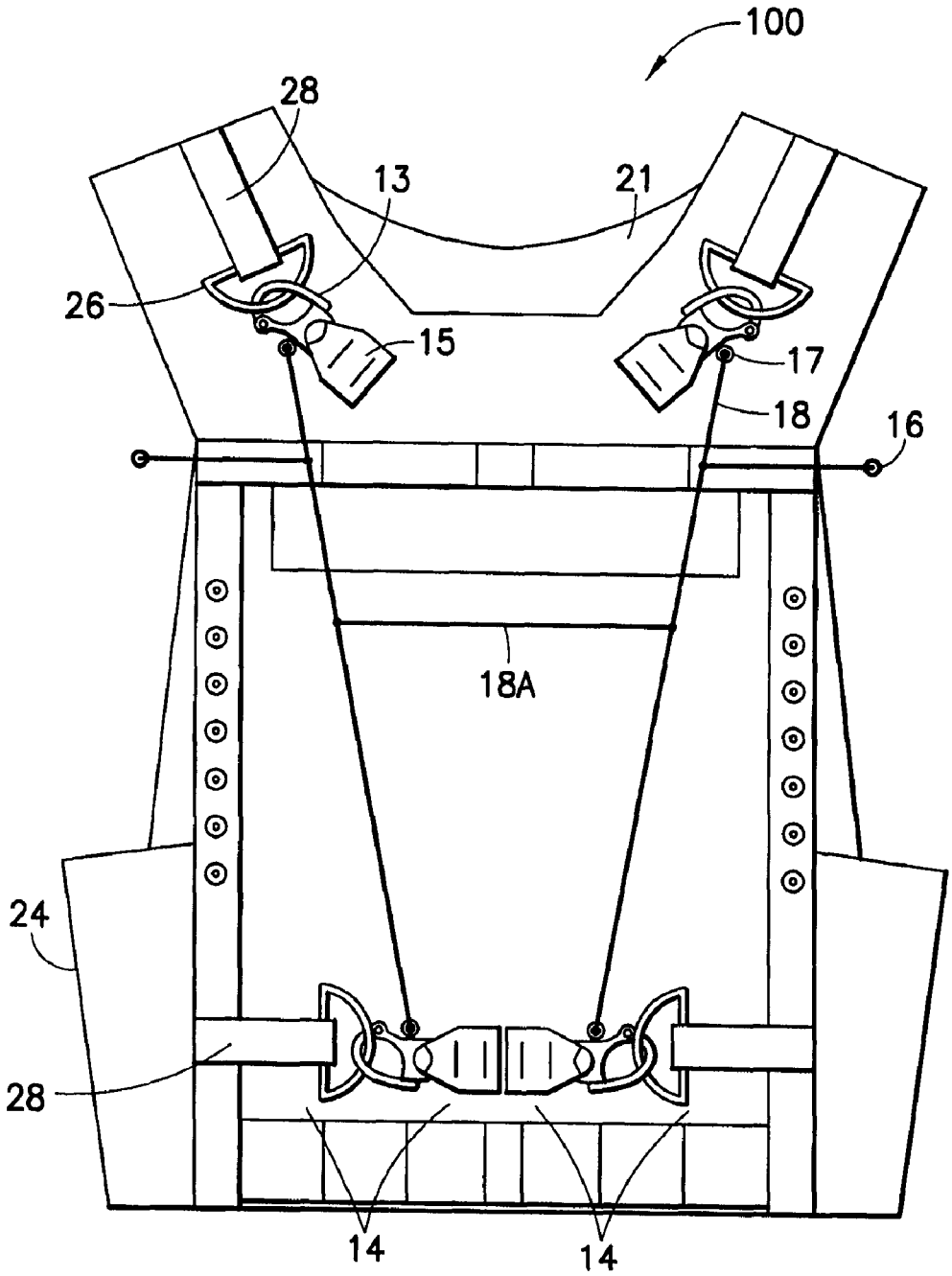
FIG. 5 illustrates a pull cord configuration for use in connection with the present invention.

In another embodiment, as illustrated in FIGS. 1B and 5, an additional cord 18*a* can be utilized to configure cord 18 to connect to all of the release knobs 17 on all the releasable hooks 13. This configuration results in all of the releasable hooks 13 disengaging simultaneously, and complete detachment of the front portion 10 from the rear portion 20 when the pull cord 16 is pulled. Alternatively, as depicted in FIG. 4, at least two release knobs 17 on two corresponding releasable hooks 13 can be connected by cord 18, such that pulling the pull cord 16 detaches the front portion 10 from the rear portion 20 only on one side of the tactical ballistic vest 100.

Figure 3:
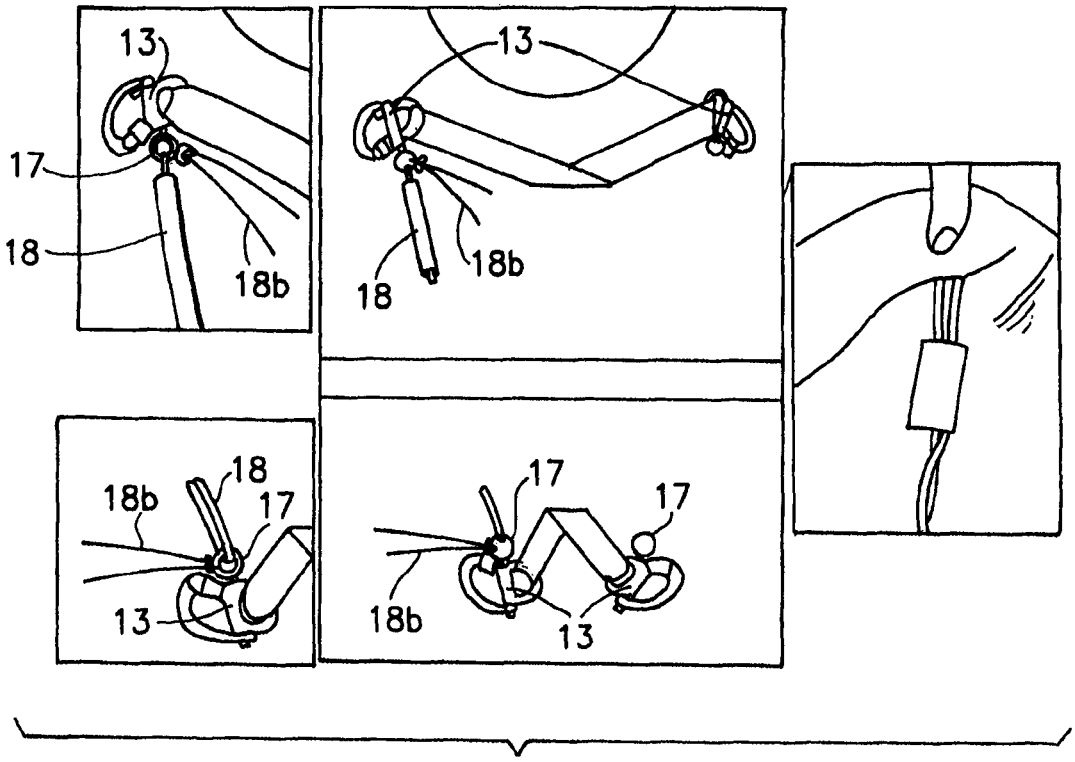
FIG. 3 illustrates a close-up view of components of connectors and a sample component layout for use in connection with an embodiment of the present invention.

In another embodiment illustrated in FIG. 3, the cord 18 can be parachute cord and may be encased in a plastic sheath or tubing to minimize fraying. In addition, the release knobs 17 may include a small ring attachment to facilitate attaching cord 18 to the release knobs 17. As a preventive measure in the event cord 18 were to break, each releasable hook 13 can include a back-up cord 18*b* that can be utilized to open the releasable hook 13.

In operation, when the tactical ballistic vest 100 is worn, the shoulder portions 22 of the rear portion 20 engage the shoulder portions 12 of the front portion 10. The rings 26 can then be inserted into the releasable hooks 13 on the front portion 10, thereby locking the front and rear portions together at the shoulders. Similarly, the side portions 24 of the rear portion 20 overlap with the side portions 19 of the front portion 10. Once again, the rings 26 can then be inserted into the releasable hooks 13 on the front portion 10 at the waist, thereby locking the front and rear portions together at the sides of the waist as well.

To release the front portion 10 from the rear portion 20 of ballistic vest 100, pull cord 16 may be pulled to disengage at least two connectors 14. In the configuration illustrated in FIG. 4, pulling only one of the two pull cords 16 results in two of the connectors 14 disengaging on the same side at the shoulder and at the waist.

Specifically, pulling the pull cord 16 causes the release knob 17 to open each corresponding releasable hook 13, thereby releasing the entrapped rings 26. The front portion 10 and rear portion 20 then separate, and the tactical ballistic vest detaches on one side. Alternatively, utilizing the cord configuration depicted in FIG. 5, when pull cord 16 is pulled, this results in all of the releasable hooks 13 disengaging simultaneously, and complete detachment of the front portion 10 from the rear portion 20.

Figure 6A:
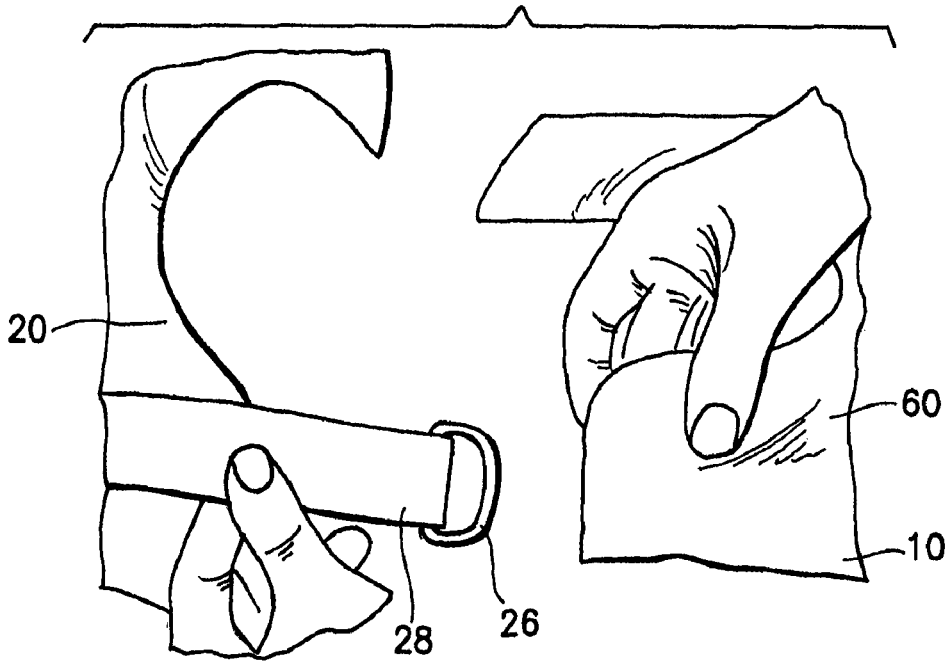
FIGS. 6A through 6D illustrate the reassembly of a protective outer garment having a quick release system in accordance with the principles of the present invention.

FIGS. 6A through 6D illustrate the reassembly of a protective outer garment having a quick release system in accordance with the principles of the present invention. As shown in FIG. 6A, each ring 26 of the rear portion 20 can engage a corresponding hook 13 of front portion 10. In an embodiment of the present invention, a covering 60, made of a ballistic protective material, such as Kevlar, can be provided to protect the connectors 14 from secondary fragmentation that may occur if a bullet were to strike a releasable hook 13 or ring 26.

Figure 6B:
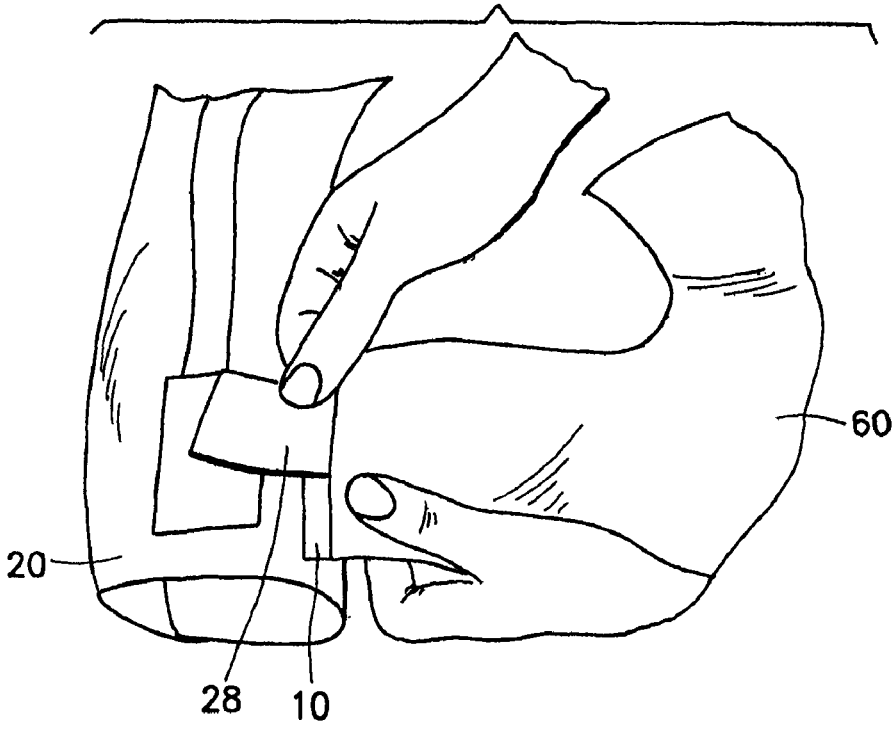
Figure 6C:
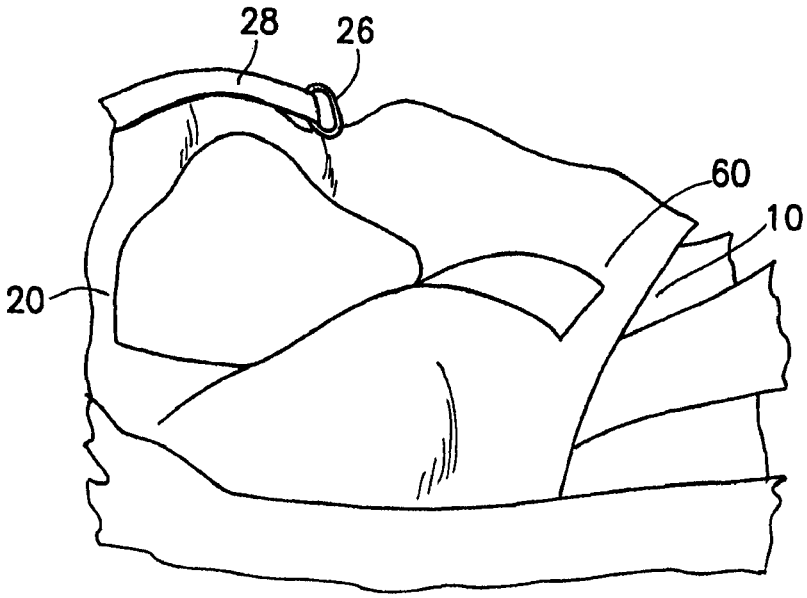
Figure 6D:
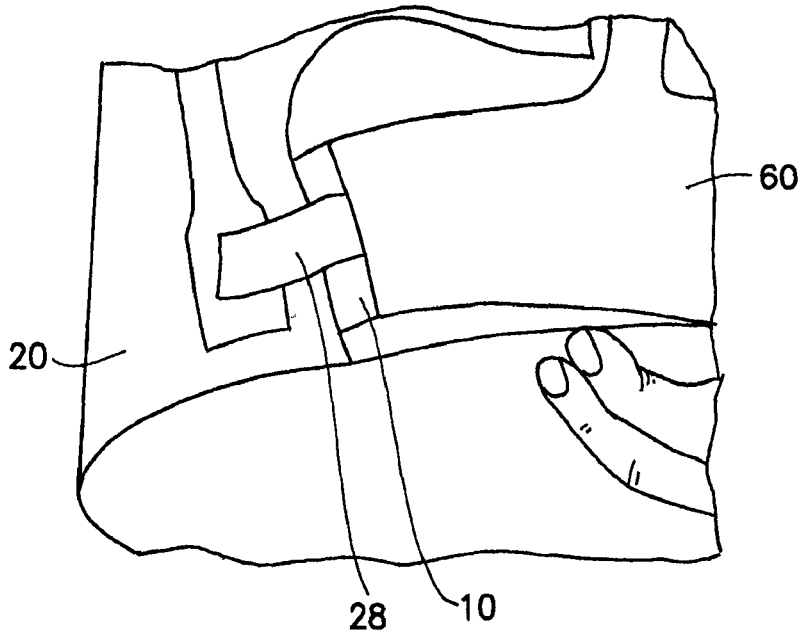

In FIG. 6B, the ring 26 and strap 28 can be passed under the covering 60 on the front portion 10. In FIG. 6C, the releasable hook 13 can be clasped around the ring 26, thereby locking the rear portion 20 and front portion 10 at that shoulder, as shown in FIG. 6D. This process can be repeated for the remaining connectors at the opposite shoulder and at both sides of the waist.

Although described primarily as being simultaneously releasable, the connectors can be individually released as well. For example, all four connectors can be simultaneously released resulting in the complete detachment of the front and rear portions, and rapid removal of the entire vest. Alternatively, a shoulder and a side connector can be detached on the same side of the body, so that a wearer can remove the vest, but still be partially protected by the vest. In addition, due to less operating parts and the configuration of the connectors, the present invention can offer up to 95% faster reassembly of a detached garment over the prior art systems.

The embodiments of the present invention discussed in this application are primarily focused on tactical ballistic vests, body armor vests, and other protective vests. However, those skilled in the art will appreciate that the quick release system of the present invention can also be configured, and utilized on other protective outer garments including safety vests, life preservers, harnesses, parachutes, military packs, backpacks and other garments.

While the invention has been described in connection with the specific embodiments thereof, it will be understood that it is capable of further modification. Furthermore, this application is intended to cover any variations, uses, or adaptations of the invention, including such departures from the present disclosure as come within known, or customary practice in the art to which the invention pertains.

What is claimed is:

1. A ballistic garment, comprising:

a front panel of the ballistic garment;

a rear panel of the ballistic garment;

a plurality of rings, wherein each of the plurality of rings is fastened to a first end of a respective anchor element and each of a second end of each respective anchor element is fixed to the rear panel of the ballistic garment;

at least one releasable hook for releasably attaching the front panel of the ballistic garment to the rear panel of the ballistic garment, wherein the at least one releasable hook is fastened to the front panel of the ballistic garment;

wherein each of the plurality of rings is releasably clasped by the at least one releasable hook;

wherein a cover at least partially covers the plurality of rings and the at least one releasable hook; and a pull cord coupled to the at least one releasable hook, wherein the pull cord actuates the at least one releasable hook to disengage the at least one releasable hook to which the pull cord is coupled from the at least two rings to allow detachment of at least a part of the front panel of the ballistic garment from at least a part of the rear panel of the ballistic garment.

2. The ballistic garment of claim 1, wherein each of the plurality of rings is selected from the group consisting of: D-rings, O-rings, and loops.

3. The ballistic garment of claim 1, wherein the at least one releasable hooks is located on the front portion of the protective garment.

4. The ballistic garment of claim 1, wherein the at least one releasable hooks is located on the rear portion of the protective garment.

5. The ballistic garment of claim 1, wherein the ballistic garment has a shoulder area and a waist area and wherein the pull cord is coupled to the releasable hooks to permit detachment of the front portion from the rear portion at the shoulder area and waist area of the ballistic garment.

6. The ballistic garment of claim 1, wherein the ballistic garment is a vest.

7. The ballistic garment of claim 1, wherein the ballistic garment has a left side and a right side, and wherein the pull cord is coupled to the at least one releasable hooks to permit detachment of the front panel of the ballistic garment from the rear panel of the ballistic garment at one of the left side and the right side of the ballistic garment while leaving the front panel of the ballistic garment and the rear panel of the ballistic garment attached at the other side of the ballistic garment.

8. The ballistic garment of claim 1, further comprising a plurality of back-up cords, wherein each of the plurality of back-up cords is attached to a corresponding one of the at least one releasable hooks, each of the plurality of back-up cords being capable of disengaging a corresponding one of the at least one releasable hooks from a corresponding one of the at least two rings without use of the pull cord.

9. A method for removing a ballistic garment, the method comprising:

wearing a ballistic garment having: a front panel of the ballistic garment; a rear panel of the ballistic garment; a plurality of rings, wherein each of the plurality of rings is fastened to a first end of a respective anchor element and each of a second end of each respective anchor element is fixed to the rear panel of the ballistic garment; at least one releasable hook for releasably attaching the front panel of the ballistic garment to the rear panel of the ballistic garment, wherein the at least one releasable hook is fastened to the front panel of the ballistic garment; wherein each of the plurality of rings is releasably clasped by the at least one releasable hook; wherein a cover at least partially covers the at least two rings and the at least one releasable hook; and pulling a pull cord coupled to the at least one releasable hook, wherein the pull cord actuates the at least one releasable hook to disengage the at least one releasable hook to which the pull cord is coupled from the at least two rings to allow detachment of at least a part of the front panel of the ballistic garment from at least a part of the rear panel of the ballistic garment.

10. The ballistic garment of claim 1, wherein the ballistic garment comprises at least one of soft armor and plate protection.

11. The method of claim 9, wherein the ballistic garment comprises at least one of soft armor and plate protection.

12. The method of claim 9, wherein the ballistic garment has a left side and a right side, and wherein the pull cord is coupled to the at least one releasable hooks to permit detachment of the front panel of the ballistic garment from the rear panel of the ballistic garment at one of the left side and the right side of the ballistic garment while leaving the front panel of the ballistic garment and the rear panel of the ballistic garment attached at the other side of the ballistic garment.

13. A ballistic garment, comprising:

a front panel of the ballistic garment;

a rear panel of the ballistic garment;

a plurality of rings, wherein each of the plurality of rings is fastened to a first end of a respective anchor element and each of a second end of each respective anchor element is fixed to the front panel of the ballistic garment;

at least one releasable hook for releasably attaching the front panel of the ballistic garment to the rear panel of the ballistic garment, wherein the at least one releasable hook is fastened to the rear panel of the ballistic garment;

wherein each of the plurality of rings is releasably clasped by the at least one releasable hook;

wherein a cover at least partially covers the plurality of rings and the at least one releasable hook; and a pull cord coupled to the at least one releasable hook, wherein the pull cord actuates the at least one releasable hook to disengage the at least one releasable hook to which the pull cord is coupled from at least two rings to allow detachment of at least a part of the front panel of the ballistic garment from at least a part of the rear panel of the ballistic garment.

* * * * *